US010641138B2

(12) United States Patent
Altherr et al.

(10) Patent No.: US 10,641,138 B2
(45) Date of Patent: May 5, 2020

(54) VALVE DRIVE FOR AN INTERNAL COMBUSTION ENGINE

(71) Applicant: Mahle International GmbH, Stuttgart (DE)

(72) Inventors: Patrick Altherr, Stuttgart (DE); Thorsten Ihne, Stuttgart (DE); Markus Walch, Bretten (DE)

(73) Assignee: Mahle International GmbH (DE)

( * ) Notice: Subject to any disclaimer, the term of this patent is extended or adjusted under 35 U.S.C. 154(b) by 36 days.

(21) Appl. No.: 15/942,376

(22) Filed: Mar. 30, 2018

(65) Prior Publication Data

US 2018/0283226 A1 Oct. 4, 2018

(30) Foreign Application Priority Data

Mar. 31, 2017 (DE) ..... 10 2017 205 538

(51) Int. Cl.
*F01L 1/34* (2006.01)
*F01L 1/26* (2006.01)
(Continued)

(52) U.S. Cl.
CPC ..... *F01L 1/267* (2013.01); *F01L 1/047* (2013.01); *F01L 1/053* (2013.01); *F01L 1/18* (2013.01);
(Continued)

(58) Field of Classification Search
CPC ..... F01L 1/267; F01L 13/0036; F01L 1/18; F01L 2820/031
(Continued)

(56) References Cited

U.S. PATENT DOCUMENTS 10,329,963 B2 * 6/2019 Altherr ..... F01L 1/08 123/90.39
2011/0126786 A1 6/2011 Kidooka et al.

FOREIGN PATENT DOCUMENTS

DE 19945340 A1 3/2001
DE 102011076726 A1 5/2012
(Continued)

OTHER PUBLICATIONS

Rempke, Volker, et al., Mechanische Bauelemente Und Baugruppen, Veb Verlag Technik Berlin.
(Continued)

*Primary Examiner* — Ching Chang
(74) *Attorney, Agent, or Firm* — Fishman Stewart PLLC

(57) ABSTRACT

A valve drive for an internal combustion engine may include a cam shaft, a cam follower, and an adjusting device. The cam shaft may include at least one first cam and at least one second cam The cam follower may be drivingly connected to the at least one first cam when in a first position and drivingly connected to the at least one second cam when in a second position. The adjusting device may include a first engagement element configured to cooperate with a first sliding guide and a second engagement element configured to cooperate with a second sliding guide. The first engagement element and the second engagement element may be adjustable between a switching position and an inactive position. The adjusting device may further include a joint actuator configured to adjust at least one of the first engagement element and the second engagement element into the switching position.

20 Claims, 2 Drawing Sheets

(51) Int. Cl.

| | |
|---|---|
| ***F01L 1/18*** | (2006.01) |
| ***F01L 1/053*** | (2006.01) |
| ***F01L 1/047*** | (2006.01) |
| ***F01L 13/00*** | (2006.01) |

(52) U.S. Cl.
CPC ..... *F01L 13/0036* (2013.01); *F01L 2013/101* (2013.01); *F01L 2105/00* (2013.01); *F01L 2105/02* (2013.01); *F01L 2820/031* (2013.01)

(58) Field of Classification Search
USPC ..... 123/90.16, 90.18, 90.39, 90.44, 90.11
See application file for complete search history.

(56) References Cited

FOREIGN PATENT DOCUMENTS

| | | | |
|---|---|---|---|
| DE | 202015009047 | U1 | 8/2016 |
| JP | 2013-253482 | A | 12/2013 |
| WO | 2003083269 | A1 | 10/2003 |

OTHER PUBLICATIONS

English abstract for DE-202015009047.
English abstract for DE-19945340.
English abstract for DE-102011076726.

* cited by examiner

VALVE DRIVE FOR AN INTERNAL COMBUSTION ENGINE

CROSS-REFERENCE TO RELATED APPLICATIONS

This application claims priority to German Patent Application No. DE 10 2017 205 538.3, filed on Mar. 31, 2017, the contents of which are hereby incorporated by reference in its entirety.

TECHNICAL FIELD

The invention relates to a valve drive for an internal combustion engine as well as to an internal combustion engine comprising such a valve drive.

BACKGROUND

With the help of an adjustable, common valve drive, which can comprise two cams with a different cam stroke, it is possible to operate the cylinder of an internal combustion engine in two different operating modes. If only a single cam is used instead of two cams with a different stroke and if base circle without cam stroke is used—instead of a second cam—the cylinder can be turned off with the help of the valve drive. In such a turned-off state, a cam follower, which is coupled to a gas exchange valve of the cylinder, does not cooperate with the single cam, but with said base circle, so that the gas exchange valve is not controlled.

Such a valve drive is known for example from DE 199 45 340 A1.

To switch between the two operating modes, a cam follower is adjusted between two axial positions in the case of a common valve drive. In the case of common valve drives, the adjustment occurs with the help of two actuators. A first actuator for adjusting the valve drive from a first axial position into a second axial position is used thereby. A further, second actuator is used to adjust the cam follower from the second axial position back into the first axial position. In the case of such common valve drives, it proves to be disadvantageous that they are constructed comparatively extensively due to the use of two actuators, which is associated with high production costs.

SUMMARY

It is an object of the present invention to show new ways when developing valve drives. In particular, a valve drive, which is characterized by reduced production costs and a reduced need for installation space, is to be created.

This object is solved by means of the subject matter of the independent claim(s). Preferred embodiments are the subject matter of the dependent claim(s).

It is thus the basic idea of the invention to equip a valve drive with only a single actuator, which can be used to adjust the cam follower from a first into a second axial position as well as vice versa, thus back from the second into the first axial position. According to the invention, such an actuator is part of an adjusting device, which comprises two engagement elements and two sliding guides. A first engagement element and a corresponding first sliding guide serve to adjust the cam follower from the first into the second position. A second engagement element and a corresponding second sliding guide serve to adjust the cam follower from the second position into the first axial position. Both engagement elements are controlled by the common actuator, for the purpose of which the actuator can optionally be brought into operative connection with the first or second engagement element.

The provision of two separate actuators, as is typical in the case of common valve drives, can thus be forgone in the case of the valve drive proposed here. This leads to significant cost advantages in the production of the valve drive.

A valve drive according to the invention for an internal combustion engine comprises a cam shaft, on which a first cam and, axially adjacent, a second cam are arranged in a rotationally fixed manner. The valve drive also comprises a cam follower, which can be axially adjusted between a first position and a second position by means of an adjusting device. In the first position, the cam follower is drivingly connected to the first cam and to the second cam in the second position. The adjusting device comprises an adjustable first engagement element, which can cooperate with a first sliding guide, which is provided on the cam shaft, for adjusting the cam follower from the first into the second position. The adjusting device further comprises an adjustable second engagement element, which can cooperate with a second sliding guide, which is provided on the cam shaft, for adjusting the cam follower from the second into the first position. The first engagement element and the second engagement element can in each case be adjusted between a switching position, in which the respective engagement element cooperates with the corresponding sliding guide, and an inactive position, in which this cooperation is eliminated.

In the switching position, the first engagement element preferably engages with the first sliding guide and is arranged at a distance to the sliding guide in the inactive position. The same preferably applies mutatis mutandis for the second engagement element.

According to the invention, the adjusting device comprises a joint actuator for optionally adjusting the first or second engagement element into the switching position. In other words, the valve drive according to the invention needs only a single actuator to adjust the cam follower between the first and the second axial position.

According to a preferred embodiment, the actuator can be axially adjusted between a first actuator position and a second actuator position, wherein the actuator is able to cooperate with the first engagement element in the first actuator position and with the second engagement element in the second actuator position. In this embodiment, the actuator is thus realized in such a way that it cooperates with the two engagement elements. Said actuator can thus activate an adjustment of the cam follower from the first into the second axial position—with the help of the first engagement element. The same actuator can likewise also activate an adjustment of the cam follower from the second position into the first position—with the help of the second engagement element. Particularly preferably, the actuator can also be embodied so as to be adjustable into at least one intermediate position between the first and the second actuator position, in which the actuator neither cooperates with the first nor with the second engagement element. The at least one intermediate position is typically adjusted when no adjustment of the cam follower from the first into the second axial position or vice versa is to occur. The actuator is thus inactive in this case.

Particularly advantageously, the actuator and the cam follower can be adjusted along a joint axial direction. Only particularly little installation space is thus required for the valve drive in the directions perpendicular to said axial direction, i.e. the valve drive is of a particularly compact construction in this variation.

In an advantageous further development, the actuator comprises an actuator housing, in which an actuator element is accommodated in a partial and axially adjustable manner. In this embodiment, the actuator element has a first axial element section for cooperating with the first engagement element and a second axial element section for cooperating with the second engagement element. The first element section thereby protrudes from the actuator housing at least in the first actuator position, and the second element section at least in the second actuator position for cooperating with the corresponding engagement element. An actuator comprising the above-mentioned characteristics is set up with a particularly simple construction and can thus be realized in a cost-efficient manner.

Particularly preferably, the first element section is a first axial end section of the actuator element and the second element section is a second axial end section of the actuator element, which is located axially opposite the first axial end section. This allows for a cooperation of the actuator element with two different engagement elements, even if they are arranged axially at a distance to one another—as are the two corresponding sliding guides—which is frequently the case in valve drives for technical reasons.

According to another preferred embodiment, an accommodation, which extends axially and in which the actuator element, which is preferably embodied as switch rod, is accommodated in an axially adjustable manner, is embodied in the actuator housing. The actuator element can be realized in a permanently mechanically stable manner, while nonetheless being capable of being displaced relative to the actuator housing in this way.

Advantageously, the accommodation can comprise two passage openings, which are arranged on opposite axial front sides of the actuator housing. The actuator element or the switch rod, respectively, hereby engages through the two passage openings, so that the actuator element or the switch rod, respectively, protrudes axially from the actuator housing with the two axial end sections, as required for cooperating with the engagement elements.

In a further advantageous further development, the actuator element, which is preferably embodied as switch rod, in each case has a ramp in the first and second axial end section or in each case tapers axially away from the actuator housing in the first and second end section. Both measures facilitate the adjustment of the respective engagement element from the inactive position into the switching position by means of mechanical contact with the corresponding ramp-like or tapering axial end section, respectively.

In another advantageous further development, the actuator is embodied as electromagnetic actuator. Such an actuator, which is based on magnetic interaction, allows for a particularly accurate adjustment of the actuator element during the operation of the valve drive. In this further development, the electromechanical actuator comprises a field coil, which is stationarily arranged in the actuator housing and to which power can be supplied, for creating a magnetic field. Provision is further made on the actuator element for a magnetic body of a magnetic material for cooperating with the magnetic field of the field coil. In an alternative variation, the field coil can be arranged on the actuator element and the magnetic body on the actuator housing.

According to a further preferred embodiment, a pretensioning element, preferably a resilient element, which pretensions the actuator element towards the first or second actuator position by generating a pretensioning force, is arranged in the actuator housing. In the case of a failure of the field coil, such a pretensioning element ensures that the actuator is independently adjusted into the first or second actuator position, respectively. A fail-safe function is realized in the actuator in this way.

In an advantageous further development, a magnetic element, which, by means of magnetic interaction with the magnetic body, permanently generates a magnetic force, which is opposite to the pretensioning force and which is smaller than the pretensioning force, is arranged in the actuator housing. Compared to embodiments without such a magnetic element, the field coil thus only needs to generate a magnetic field with reduced field strength, so that the power supply can be reduced as well.

Further important features and advantages of the invention follow from the subclaims, from the drawings, and from the corresponding figure description by means of the drawings.

It goes without saying that the above-mentioned features and the features, which will be described below, cannot only be used in the respective specified combination, but also in other combinations or alone, without leaving the scope of the present invention.

Preferred exemplary embodiments of the invention are illustrated in the drawings and will be described in more detail in the description below.

BRIEF DESCRIPTION OF THE DRAWINGS

In each case schematically

DETAILED DESCRIPTION

Figure 1:
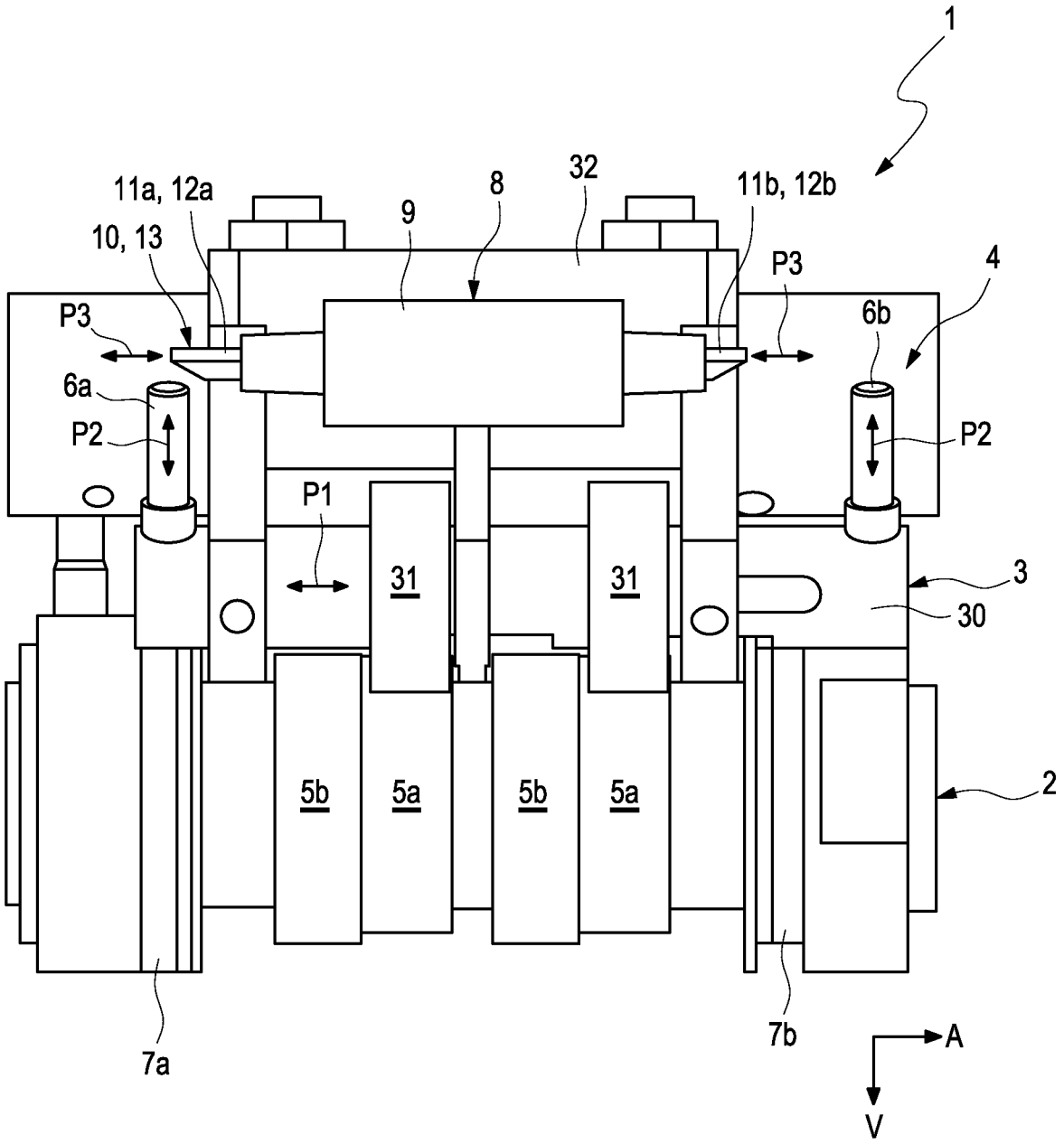
FIG. 1 shows an example of a valve drive according to the invention in perspective illustration.

FIG. 1 illustrates a valve drive 1 for an internal combustion engine. The valve drive 1 comprises a cam shaft 2, on which two first cams 5*a* and axially adjacent two second cams 5*b* are arranged in a rotationally fixed manner. In addition, the valve drive 1 comprises a cam follower 3 comprising a roller bolt 30 and two rotatable rollers 31. The cam follower 3 is attached to a tilt lever 32, by means of which outlet valves of the internal combustion engine can be controlled. The two rollers 31 and the roller bolt 30 can be adjusted relative to the tilt lever 32 along an axial direction A between a first position and a second position (see arrow P1). In the context at hand, the wording "axial" and "along the axial direction A" is used equivalently. In the first position shown in FIG. 1, the two rollers 31 of the cam follower 3 are drivingly connected to the first cams 5*a*. In the second position, the two rollers 31 of the cam follower 3 are drivingly connected to the second cams 5*b*. In variations of the example, provision can also be made for a different number of first and second cams 5*a*, 5*b*. In a simplified variation, provision can in each case be made for only exactly one first cam 5*a* and exactly one second cam 5*b*.

The adjusting device 4 further comprises an adjustable first engagement element 6*a*, which cooperates with a first sliding guide 7*a*, which is provided on the cam shaft 2, for axially adjusting the cam follower 3 from the first into the second position. The adjusting device 4 likewise comprises an adjustable second engagement element 6*b*, which cooperates with a second sliding guide 7*b*, which is provided on the cam shaft 2, for adjusting the cam follower 3 from the second into the first position.

Both of the two engagement elements 6*a*, 6*b* are arranged on the roller bolt 30 of the cam follower 3. The first engagement element 6*a* as well as the second engagement element 6*b* can in each case be adjusted between a switching position, in which the engagement element 6*a*, 6*b* cooperates with the corresponding sliding guide 7*a*, 7*b*, and an inactive position, in which this cooperation is eliminated. In the example scenario, the two engagement elements 6*a*, 6*b* can be adjusted along an adjusting direction V perpendicular to the axial direction A for this purpose (see arrow P2). In the switching position, the respective engagement element 6*a*, 6*b* engages with the corresponding sliding guide 7*a*, 7*b*. In the inactive position, the respective engagement element 6*a*, 6*b* is arranged at a distance to the corresponding sliding guide 7*a*, 7*b*. In addition, the adjusting device 4 comprises a joint actuator 8 for selectively adjusting the first or second engagement element 6*a*, 6*b* from the inactive position into the switching position.

Figure 2:
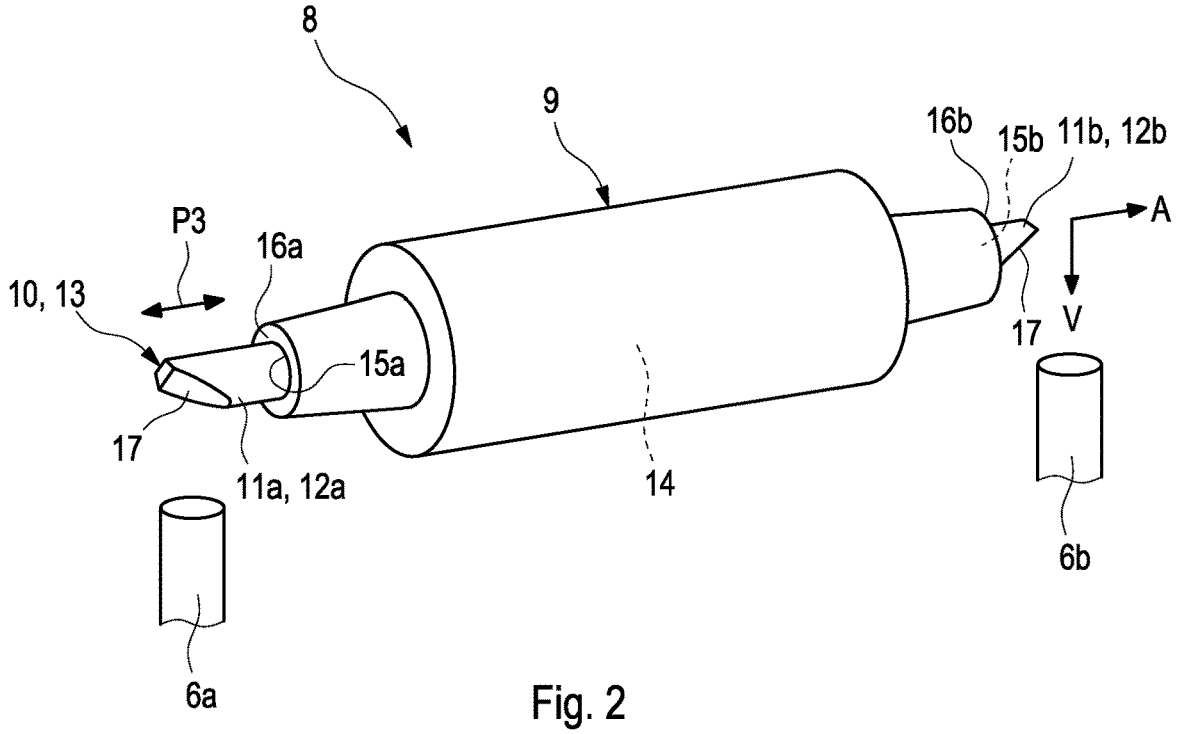
FIG. 2 shows the actuator of the valve drive of FIG. 1 in separate perspective illustration.

FIG. 2 shows the joint actuator 8 of the valve drive 1 in separate illustration. The actuator 8 can be adjusted between a first actuator position and a second actuator position (see arrow P3) along the axial direction A. In the first actuator position, the actuator 8 cooperates with the first engagement element 6*a* and with the second engagement element 6*b* in the second actuator position. FIGS. 1 and 2 show the actuator 8 in the first actuator position. The actuator 8 can furthermore be adjusted into at least one intermediate position between the first and the second actuator position, in which it neither cooperates with the first nor with the second engagement element 6*a*, 6*b* (not shown).

According to FIG. 2, the actuator 8 comprises an actuator housing 9, in which an actuator element 10 is accommodated in a partial and axially adjustable manner. The actuator element 10 is preferably embodied as switch rod 13. The actuator element 10 or the switch rod 13, respectively, have a first axial element section 11*a* for cooperating with the first engagement element 6*a* as well as a second axial element section 11*b* for cooperating with the second engagement element 6*b*. Both of the two element sections 11*a*, 11*b* protrude axially from the actuator housing 9, so that they can cooperates with the corresponding engagement element 6*a*, 6*b* in the first or second actuator position, respectively. In the example scenario of FIGS. 1 and 2, the first element section 11*a* is a first axial end section 12*a* of the actuator element 10, and the second element section 11*b* is a second axial end section 12*b* of the actuator element 10, which is located axially opposite the first axial end section 12*b*.

The adjusting of the cam follower 3 from the first position shown in FIG. 1 into the second position occurs as follows: The actuator element 10 or the switch rod 13, respectively, is adjusted into the first actuator position. When the actuator 8 is adjusted in the first actuator position, the cam follower 3 is pushed with the engagement element 6*a* against the first axial end section 12*a* or the first element section 11*a*, respectively, of the actuator element 10 as a result of the lifting movement generated by the cam shaft 2 and is adjusted into the switching position in this way, in which the first engagement element 6*a* engages with the first sliding guide 7*a*. The first sliding guide 7*a* is embodied in such a way that the cam follower 3 is adjusted into the second position by the engagement element 6*a* by means of the rotation of the cam shaft 2 with the first sliding guide 7*a*.

The adjusting of the cam follower 3 from the non-illustrated second position into the first position occurs as follows: The actuator element 10 or the switch rod 13, respectively, is adjusted into the second actuator position (not shown). When the actuator 8 is adjusted in the second actuator position, the cam follower 3 is pushed with the engagement element 6*b* against the second axial end section 12*b* or the second element section 11*b*, respectively, of the actuator element 10 as a result of the lifting movement generated by the cam shaft 2 and is adjusted into the switching position in this way, in which the second engagement element 6*b* engages with the second sliding guide 7*b*. The second sliding guide 7*b* is thereby embodied in such a way that the cam follower 3 is adjusted into the first position by the engagement element 6*b* by means of the rotation of the cam shaft 2 with the second sliding guide 7*b*.

According to FIG. 2, an accommodation 14 can be present in the actuator housing 9, in which the actuator element 10 or the switch rod 13, respectively, is arranged so as to be axially adjustable. The accommodation 14 comprises two passage openings 15*a*, 15*b*, which are arranged on mutually opposite axial front sides 16*a*, 16*b* of the actuator housing 10, and through which the actuator element 10 or the switch rod 13, respectively, engage. According to FIG. 2, the actuator element 10, which is embodied as switch rod 13, can in each case have a ramp 17 in the first and second axial end section 12*a*, 12*b*. In a non-illustrated variation, the switch rod 13 or the actuator element 10, respectively, can in each case taper axially away from the actuator housing 9 in the first and second end section 11*a*, 11*b*.

Figure 3:
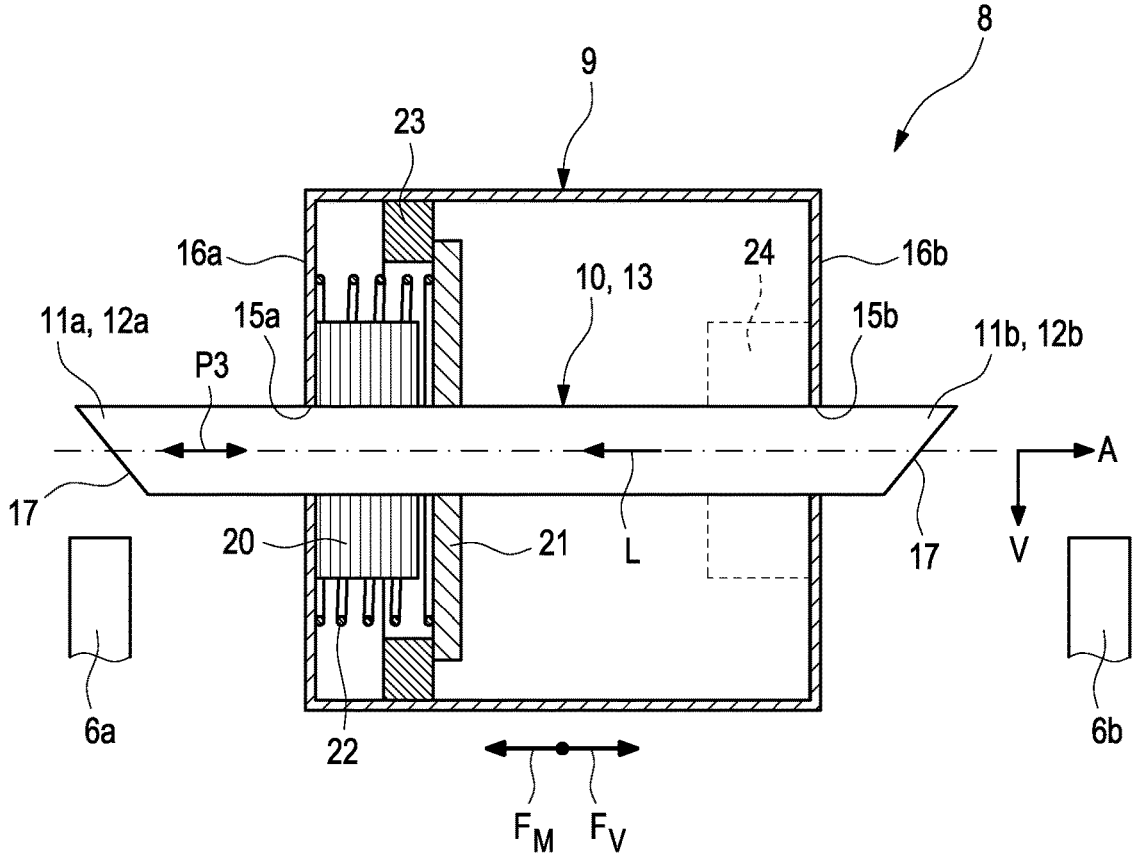
FIG. 3 shows an electromagnetic actuator of the valve drive in a roughly schematic sectional illustration.

As is shown in the schematic illustration of the actuator 8 in FIG. 3, the actuator 8 can be embodied as electromagnetic actuator. For this purpose, the actuator 8 has a field coil 20, which is stationarily arranged in the actuator housing 9 and to which power can be supplied, for generating a magnetic field. A magnetic body 21 of a magnetic material is arranged on the actuator element 10 in a stationary manner. The magnetic body 21 can be embodied in a plate-like manner. The magnetic field generated by the magnetic body 21 cooperates with the magnetic field of the field coil 20. As a result of the magnetic interaction between the two magnetic fields, the actuator element 10 is axially adjusted between the first and second actuator position relative to the actuator housing 9. In a variation of the example, which is not illustrated in detail in FIG. 3, it is conceivable to arrange the field coil 20 on the actuator element 10 and to arrange the magnetic body 21 on the actuator housing 9.

As can also be seen in FIG. 3, provision can be made in the actuator housing 9 for a pretensioning element 22, which is preferably embodied as resilient element. Such a resilient element can for example be realized by means of a helical spring. The pretensioning element 22 pretensions the actuator element 10 towards the second actuator position (not shown in FIG. 3) by generating a pretensioning force Fv.

By providing power to the field coil 20, the actuator element 10 or the switch rod 13, respectively, is moved into the first actuator position shown in FIG. 3 with the magnetic body 21 against the pretensioning force Fv, which is generated by the pretensioning element 22. The actuator element 10 thus moves from the second actuator position, which is not shown in FIG. 3, to the left—suggested by the arrow L in FIG. 3—into the first actuator position shown in FIG. 3. In response to the movement towards the first actuator position, the pull between the magnetic body 21 and the field coil 20 increases as a result of the decreasing distance of the magnetic body 21 to the field coil 20, whereby the pretensioning force Fv, which also increases, is counteracted. As soon as the first actuator position is reached, the electrical determination of the field coil 20 can thus be reduced, so that the actuator element 10 is barely held in position due to the resulting balance of forces. In the case of a failure, thus for example when the field coil 20 does not generate a magnetic field as a result of a fault, the actuator element 10 is moved back into the second actuator position as a result of the pretensioning force Fv, which is generated by the pretensioning element 22. A fail-safe principle can thus be realized by means of the pretensioning element 22.

In addition, a magnetic element 23 of a magnetic material, which permanently generates a magnetic force FM opposite to the pretensioning force Fv as a result of magnetic interaction with the magnetic body 21, can be arranged in the actuator housing 9. The magnetic element 23 can for example be a permanent magnet or can consist of a ferromagnetic material. The magnetic element 23 and the magnetic body 21 are matched to one another and are arranged in the actuator housing 9 in such a way that the magnetic element 23 and the magnetic body 21 attract magnetically. The magnetic element 23, in cooperation with the magnetic body 21, thus supports a movement of the actuator element 10 into the first actuator position. The magnetic force FM generated by the magnetic element 23 is thereby smaller than the pretensioning force Fv. The magnetic field generated by the field coil 20 can thus be reduced to overcome the pretensioning force Fv, which is generated by the pretensioning element 22, so that the power supply to the field coil 20 can be reduced as well.

The actuator 8 can optionally be equipped with an additional field coil 24, which is only suggested roughly schematically in FIG. 3 and which generates a magnetic field, which, in cooperation with the magnetic field generated by the magnetic body 21, supports a movement of the actuator element 10 towards the first actuator position.

The invention claimed is:

1. A valve drive for an internal combustion engine, comprising:

a cam shaft including at least one first cam and at least one second cam axially adjacent the at least one first cam, the at least one first cam and the at least one second cam arranged on the cam shaft in a rotationally fixed manner; and a cam follower axially adjustable between a first position and a second position via an adjusting device, the cam follower drivingly connected to the at least one first cam when in the first position and drivingly connected to the at least one second cam when in the second position;

wherein the adjusting device includes an adjustable first engagement element comprising a pin cooperatable with a first sliding guide arranged on the cam shaft for adjusting the cam follower from the first position into the second position;

wherein the adjusting device further includes an adjustable second engagement element comprising a pin cooperatable with a second sliding guide arranged on the cam shaft for adjusting the cam follower from the second position into the first position;

wherein the first engagement element is adjustable between a first switching position, in which the first engagement element cooperates with the first sliding guide, and a first inactive position, in which the first engagement element does not cooperate with the first sliding guide;

wherein the second engagement element is adjustable between a second switching position, in which the second engagement element cooperates with the second sliding guide, and a second inactive position, in which the second engagement element does not cooperate with the second sliding guide; and wherein the adjusting device further includes a joint linear actuator configured to adjust at least one of i) the first engagement element into the first switching position, and ii) the second engagement element into the second switching position.

2. The valve drive according to claim 1, wherein the joint linear actuator is axially adjustable between a first actuator position and a second actuator position, the joint linear actuator cooperating with the first engagement element when in the first actuator position and cooperating with the second engagement element when in the second actuator position.

3. The valve drive according to claim 2, wherein:

the joint linear actuator includes an actuator housing, in which an actuator body of the joint linear actuator is at least partially arranged in an axially adjustable manner;

the actuator body includes a first axial body section configured to cooperate with the first engagement element and a second axial body section configured to cooperate with the second engagement element; and the first body section protrudes from the actuator housing such that the first body section is cooperatable with the first engagement element at least when the joint linear actuator is in the first actuator position, and the second body section protrudes from the actuator housing such that the second body section is cooperatable with the second engagement element at least when the joint linear actuator is in the second actuator position.

4. The valve drive according to claim 3, wherein the first body section is a first axial end section of the actuator body and the second body section is a second axial end section of the actuator body disposed axially opposite the first axial end section.

5. The valve drive according to claim 4, wherein the actuator body at least one of i) includes a ramp in the first axial end section and the second axial end section and ii) tapers axially away from the actuator housing in the first axial end section and the second axial end section.

6. The valve drive according to claim 3, wherein the actuator housing includes an accommodation, in which the actuator body is accommodated in an axially adjustable manner.

7. The valve drive according to claim 6, wherein the accommodation includes two passage openings arranged on opposite axial front sides of the actuator housing and through which the actuator body engages.

8. The valve drive according to claim 6, wherein the actuator body is a switch rod.

9. The valve drive according to claim 3, wherein the joint linear actuator is an electromagnetic actuator including a field coil configured to provide a magnetic field when supplied with power and a magnetic body composed of at least one of a magnetic material and a magnetizable material configured to cooperate with the magnetic field of the field coil, and wherein one of i) the field coil is arranged stationarily within the actuator housing and the magnetic body is arranged on the actuator body and ii) the field coil is arranged on the actuator body and the magnetic body is arranged stationarily within the actuator housing.

10. The valve drive according to claim 9, further comprising:

a pretensioning element arranged within the actuator housing, the pretensioning element configured to pretension the actuator body towards one of the first actuator position and the second actuator position via a pretensioning force; and a magnetic element arranged in the actuator housing, the magnetic element magnetically interacting with the magnetic body and providing a magnetic force opposite the pretensioning force, and wherein the magnetic force is smaller than the pretensioning force.

11. The valve drive according to claim 9, wherein:

the joint linear actuator further includes a second field coil disposed axially opposite the field coil relative to the actuator body, the second field coil configured to provide a second magnetic field when supplied with power; and the magnetic body is configured to cooperate with the second magnetic field of the second field coil.

12. The valve drive according to claim 3, further comprising a pretensioning element arranged within the actuator housing, the pretensioning element configured to pretension the actuator body towards one of the first actuator position and the second actuator position via a pretensioning force.

13. The valve drive according to claim 12, wherein the pretensioning element is a resilient body.

14. The valve drive according to claim 3, wherein:

the actuator body is axially adjustable toward the first engagement element relative to the actuator housing such that the joint linear actuator is in the first actuator position; and the actuator body is axially adjustable toward the second engagement element relative to the actuator housing such that the joint linear actuator is in the second actuator position.

15. The valve drive according to claim 2, wherein the joint linear actuator is axially adjustable into an intermediate actuator position between the first actuator position and the second actuator position, and wherein the joint linear actuator does not cooperate with either of the first engagement element and the second engagement element when in the intermediate actuator position.

16. The valve drive according to claim 1, wherein the joint linear actuator and the cam follower are adjustable along a joint axial direction.

17. An internal combustion engine, comprising a valve drive including:

a cam shaft including at least one first cam and at least one second cam axially adjacent the at least one first cam, the at least one first cam and the at least one second cam arranged on the cam shaft in a rotationally fixed manner;

a cam follower including a roller bolt, the cam follower axially adjustable between a first position and a second position, the cam follower drivingly connected to the at least one first cam when in the first position and drivingly connected to the at least one second cam when in the second position; and an adjusting device including an adjustable first engagement element comprising a pin protruding from the roller bolt, configured to adjust the cam follower from the first position to the second position and an adjustable second engagement element comprising a pin protruding from the roller bolt configured to adjust the cam follower from the second position to the first position, the first engagement element cooperating with a first sliding guide arranged on the cam shaft when in a first switching position and not cooperating with the first sliding guide when in a first inactive position, the second engagement element cooperating with a second sliding guide arranged on the cam shaft when in a second switching position and not cooperating with the second sliding guide when in a second inactive position;

wherein the adjusting device further includes a joint linear actuator configured to selectively adjust at least one ofd the first engagement element into the first switching position, and ii) the second engagement element into the second switching position.

18. The internal combustion engine according to claim 17, wherein the joint linear actuator cooperates with the first engagement element when in a first actuator position and cooperates with the second engagement element when in a second actuator position.

19. The internal combustion engine according to claim 18, wherein:

the joint linear actuator includes an actuator housing and an actuator body at least partially arranged within the actuator housing in an axially adjustable manner; and the actuator body includes a first axial body section protruding from the actuator housing such that the first body section is cooperatable with the first engagement element at least when the joint linear actuator is in the first actuator position, and a second axial body section protruding from the actuator housing such that the second body section is cooperatable with the second engagement element at least when the joint linear actuator is in the second actuator position.

20. A valve drive for an internal combustion engine, comprising:

a cam shaft including at least one first cam and at least one second cam axially adjacent the at least one first cam, the at least one first cam and the at least one second cam arranged on the cam shaft in a rotationally fixed manner;

a cam follower axially adjustable between a first position and a second position, the cam follower drivingly connected to the at least one first cam when in the first position and drivingly connected to the at least one second cam when in the second position; and an adjusting device including an adjustable first engagement element comprising a pin configured to adjust the cam follower from the first position to the second position and an adjustable second engagement element comprising a pin configured to adjust the cam follower from the second position to the first position, the first engagement element cooperating with a first sliding guide arranged on the cam shaft when in a first switching position and not cooperating with the first sliding guide when in a first inactive position, the second engagement element cooperating with a second sliding guide arranged on the cam shaft when in a second switching position and not cooperating with the second sliding guide when in a second inactive position, the adjusting device further including a joint actuator configured to adjust at least one ofd the first engagement element into the first switching position and ii) the second engagement element into the second switching position, the joint actuator cooperating with the first engagement element when in a first actuator position, cooperating with the second engagement element when in a second actuator position, and not cooperating with either of the first engagement element and the second engagement element when in an intermediate actuator position;

wherein the joint actuator includes an actuator housing and switch rod at least partially arranged within the actuator housing in an axially adjustable manner, the switch rod including a first axial rod section protruding from the actuator housing such that the first rod section is cooperatable with the first engagement element at least when the joint actuator is in the first actuator position, and a second axial rod section protruding from the actuator housing such that the second rod section is cooperatable with the second engagement element at least when the joint actuator is in the second actuator position.

* * * * *